US008627776B2

(12) United States Patent
Scheckler

(10) Patent No.: US 8,627,776 B2
(45) Date of Patent: Jan. 14, 2014

(54) CERAMIC LINER FOR ATTACHING CERAMIC FIBER REFRACTORY INSULATION

(75) Inventor: Chad A. Scheckler, Phelps, NY (US)

(73) Assignee: Seneca Ceramics Corp., Phelps, NY (US)

( * ) Notice: Subject to any disclaimer, the term of this patent is extended or adjusted under 35 U.S.C. 154(b) by 166 days.

(21) Appl. No.: 13/222,037

(22) Filed: Aug. 31, 2011

(65) Prior Publication Data

US 2013/0047902 A1 Feb. 28, 2013

(51) Int. Cl.
*F23M 5/02* (2006.01)
*F27B 7/28* (2006.01)
*C21B 7/02* (2006.01)

(52) U.S. Cl.
USPC ..... 110/339; 432/119; 266/286

(58) Field of Classification Search
USPC ..... 110/336, 338, 339; 264/30, 643, 667; 432/119; 373/130, 137; 219/531, 536; 266/280, 281, 283, 284, 286
See application file for complete search history.

(56) References Cited

U.S. PATENT DOCUMENTS 1,661,842 A * 3/1928 McFarland ..... 373/130
4,336,086 A 6/1982 Rast
4,401,613 A * 8/1983 Abell et al. ..... 373/137
4,428,906 A 1/1984 Rozmus
4,653,171 A 3/1987 Coble
4,829,734 A 5/1989 Schraff
4,932,187 A 6/1990 Kraemer et al.
5,059,369 A 10/1991 Schiferl
5,344,799 A 9/1994 Wu
5,353,567 A 10/1994 Knight et al.
5,545,435 A 8/1996 Steffier
5,616,023 A 4/1997 Mosci
5,695,329 A * 12/1997 Orcutt ..... 432/119
7,628,611 B2 12/2009 Beiter et al.
7,628,878 B2 12/2009 Riedell et al.
7,886,495 B2 2/2011 Nebgen
2009/0241815 A1* 10/2009 Mulch et al. ..... 110/336

FOREIGN PATENT DOCUMENTS

GB 2022795 * 12/1979
GB 2022795 A 12/1979

* cited by examiner

*Primary Examiner* — Kenneth Rinehart
*Assistant Examiner* — Tavia Sullens
(74) *Attorney, Agent, or Firm* — Bernhard P Molldrem, Jr.

(57) ABSTRACT

Retainers for holding a refractory ceramic fiber insulation layer in a furnace, kiln, or forge are in the form of ceramic tile members is formed with an array of small hook structures on an inward-facing surface, which serves as the hook component of a hook-and-loop fastening system. The ceramic fibers of the insulating layer serve as the "loop" component. The tile members may be formed in a RAM press, or the hook structure can be formed using a slurry spread with refractory grains or particles.

2 Claims, 1 Drawing Sheet

CERAMIC LINER FOR ATTACHING CERAMIC FIBER REFRACTORY INSULATION

BACKGROUND OF THE INVENTION

This invention relates to fastener systems for attaching or retaining high temperature fiber ceramic liners in furnaces, forges, kilns, or other high-temperature enclosures. The invention is more particularly concerned with liners that can be applied as blocks, bricks or tiles to the inside surfaces of the high-temperature enclosures, and which have an array of hook structures formed on one surface that can grasp and hold the fibers of a refractory fiber ceramic insulating layer.

In many high-temperature applications, such as furnaces and kilns, it has become a critically important design factor to minimize heat loss through the containment walls. One common insulating material used in these applications is fiber ceramics. Ceramic fiber insulation is available in many forms such as blanket, baled modules, rigid boards or panels. Ceramic fiber may have temperature capability up to about 1800° Celsius. Many different systems have been proposed for retaining these materials on the walls and ceiling of furnaces and kilns. These have typically included metal fasteners, metal hooks that have to be somehow accommodated in the fibrous ceramic material. These systems have been complex and have not had success in all applications.

OBJECTS AND SUMMARY OF THE INVENTION

Accordingly, it is an object of the present invention to provide a system and process for reliably and easily attaching and retaining ceramic fiber insulation layer onto the interior walls of a furnace, kiln, oven or other high temperature containment, in a fashion that avoids the drawbacks of the prior art.

It is a more particular object to provide a process in which a ceramic block, brick or tile is formed with an array of small hook structures on an inward-facing surface, which serves as the hook portion of a hook-and-loop fastening system, with the ceramic fibers of the insulating layer serving as the "loop" component, in a fashion somewhat similar to the familiar Velcro™ fastening material.

Another object is to provide a technique for forming an array of hooks on one surface of the ceramic tile (brick, or block) member, which can then be affixed onto an interior wall of the kiln, furnace or the like, and which will retain the refractory ceramic fiber insulation layer. A number of different ceramic hook constructions are available, and likewise a number of processes may be employed to achieve the hook structure on the surface of the retaining tile, block, or brick members.

For simplicity of this discussion, the term "tile" will be used to include a wide variety of ceramic substrates that incorporate the retaining hook array, including traditional refractory tiles, as well as fire bricks, ceramic blocks or other suitable ceramic elements. Each tile has one side that faces the wall or ceiling of the enclosure or containment, and an opposite side that faces the interior of the enclosure and is adapted to hold and retain the ceramic fiber insulation layer.

In accordance with one aspect of the present invention, a liner attachment is provided for removably holding a ceramic fiber insulation layer on an inside surface of a kiln, forge, furnace or other similar high-temperature enclosure. The liner attachment system is formed of an arrangement of refractory ceramic tile or plate members each having a first surface adapted to face against the inside surface of the high-temperature enclosure, and a second surface adapted to fasten onto the ceramic fiber insulation layer. The second surfaces of each of the tile or plate members includes an array of hook members that project from the second surface and latch onto fibers of the ceramic fiber insulation layer. In one embodiment, the hook members are formed as an array of small-dimension ceramic posts that extend distally from the second surface of the tile members and have distal ends thereof bent in an upward (or sideways) direction, i.e., at a right angle to the post axis. The array of hook members can have a density of between about one hook member per 10 $cm^2$ and 50 hook members per $cm^2$.

In accordance with another aspect of the invention, the process of forming an attachment liner for holding a ceramic fiber insulation layer on an inside surface of a kiln, forge, furnace or other similar high-temperature enclosure, involves creating or manufacturing a number of ceramic tile members. These tile members each have a first surface adapted to be mounted against the inside surface of the high-temperature enclosure, and a second surface adapted to fasten onto fibers of the ceramic fiber insulation layer to hold the same in place in the high temperature enclosure. The process includes forming the array of hook structures on the second surface of the tile member so that the hook members project distally from the second surface of the tile member. These tiles can be formed using a so-called RAM press, of the type having a pair of opposed die members, one or both of said die members being formed of a permeable material, e.g., a plaster, to permit fluid pressure to be applied through the die member. The one of the die members that forms the second surface of the tile member has an array of narrow cavities to form an array of post members on the second surface of the clay charge when pressed to form a ceramic workpiece. A charge of a ceramic clay is placed into the RAM press, and the jaws of the press are brought together to compress the die members against one another with the clay charge between the diem members to form the ceramic workpiece. The die members are then released from one another, and compressed air or other suitable fluid is applied through the permeable die member to release the ceramic workpiece from it. This leaves the ceramic workpiece as a tile member that has an array of post members formed at its second surface. A mechanical pressure can be applied onto distal ends of the post members to bend their distal tips, thus forming the posts into hook members. Then the workpiece is fired for at a suitable temperature to form the tile, and the tile is affixed onto the wall or ceiling of the kiln, forge, furnace or other high-temperature enclosure. After these tiles are in place, the ceramic fiber layer is pressed in place against them inside the high-temperature enclosure.

The step of applying mechanical force to the tips of the posts can involve brushing the un-fired post members with a damp sponge or damp cloth to bend the tips into hook members.

In a preferred implementation, these post members are formed to be substantially 0.25 inches in length.

An alternative process for forming the liner for holding ceramic fiber insulation layer involves creating the hook structures on existing ceramic tile members. The refractory tile members are obtained, each tile member having first and second surfaces on its opposite sides. On the second surface of these tile members is applied a slurry containing one or both of a glass-forming compound and a reactive sintering compound. Onto this slurry are spread coarse grains of a refractory material such that the refractory material and the slurry are distributed over the second surfaces of the tile members. Then the tile members are fired at a suitable temperature for a sufficient time to form a bond between the refractory ceramic grains and the second surface of the refractory tile members. These bonded grains serve as the hook members to hold and retain the ceramic fiber insulation layer.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
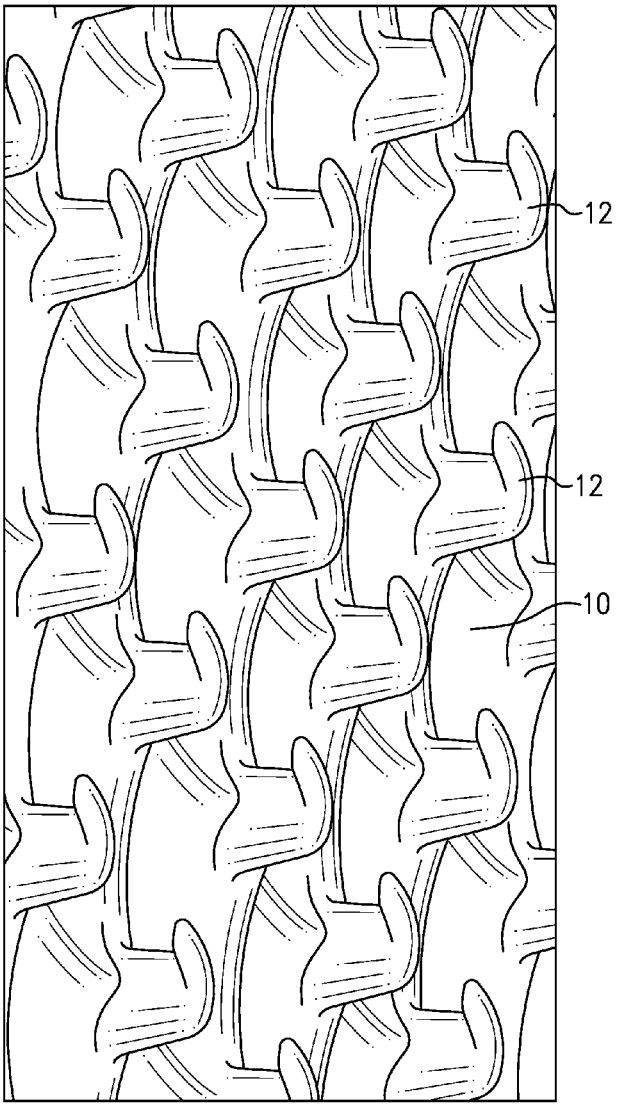
FIG. 1 is a perspective view of one surface of a refractory tile member showing hook structure according to an embodiment of this invention.
Figure 2:
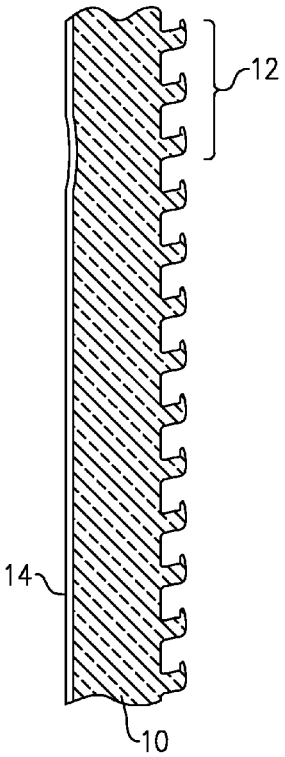
FIG. 2 is a cross section of a portion of the refractory tile member showing a back surface and the hook structure thereof on a front surface.

With reference now to the Drawing, and initially to FIG. 1, a high temperature refractory ceramic material is formed into a tile member 10, e.g., a brick, block or tile shape, with one surface of it being formed as an array of small hooks 12 in a pattern, and used to hold the ceramic fiber insulation material in place in the associated kiln, forge, or furnace. In a first embodiment, these hooks 12 are made up of a repeated pattern of small hooks (see FIG. 1) in a density ranging from about one hook per each 10 $cm^2$ to about 50 hooks per $cm^2$. FIG. 2 shows the tile 10 in cross-section with the hooks 12 on the front surface and with a back surface 14 of the tile that faces the walls or ceiling of the furnace. The array of small hooks 12 serve as the "hook" component of a hook-and-loop fastening system, and the ceramic fibers of the cooperating insulating layer serve as the "loop" component.

In this embodiment, the tile members are formed by a process known in the ceramics industry as RAM pressing. In this process the ceramic starting material, i.e., clay, requires a mixture of ceramic particles, water and a plasticizer so that the ceramic clay material behaves as a fluid when compressed in a die but remains fairly rigid when not under pressure. The RAM press has a pair of die members one or both of which are formed of a porous material, i.e., a plaster, so that compressed air can be blown through it to release the ceramic workpiece from the die. In this case the die that forms the inner or second surface of the tile member has an array of small openings or bores in it to form the array of posts, each opening or bore being typically about 0.25 inches deep, to form posts members that are about 0.25 inches long on the workpiece.

A charge of clay material, including some water and a suitable plasticizer, is inserted between the two dies of the RAM press, and the jaws are closed to compress the clay material between the two dies. Then the jaws are released, and compressed air is supplied through the porous die (or dies) to release the workpiece. The clay can have any of a wide variety of formulations. The plasticizing agent may include a ball clay, bentonite, and/or kaolin, in a range of between a few percent and up to fifty percent. At this point, the workpiece is in the form of a flat tile member with an array of small posts on the one side, i.e., the second or insulation-facing surface. After removal from the RAM press, the workpiece is immediately brushed with a damp sponge, i.e, cloth or absorptive material, to bend the tips of these post members and form hooks. An array thereof is shown in the Drawing FIGURE. Then the workpieces are fired to form the finished ceramic tile members.

In a second configuration, previously formed ceramic tile members are applied with a coat on one surface of a slurry containing glass forming compounds, or alternatively containing reactive sintering compounds, or both. The slurry would have an aqueous base, and could include fritted glass or mineral mixtures including, e.g., feldspar, clay or quartz. While the slurry is still wet, coarse grains of refractory material are spread loosely across that surface, and then the coated tile is fired in a suitable oven or kiln. The firing of the compounds in the slurry forms a bond between the refractory grains and the second surface of the tile member. In the finished, fired workpiece these grains serve as hook members, and are effective in grabbing onto fibers of the layer of ceramic fiber insulation.

Many equivalent techniques may be used to create ceramic members having hook structure thereon suited for attaching a ceramic fiber insulation layer. While the invention has been described with reference to specific preferred embodiments, the invention is certainly not limited to those precise embodiments.

I claim:

1. A liner attachment for removably holding a ceramic fiber insulation layer on an inside surface of a kiln, forge, furnace or other similar high-temperature enclosure, comprising a plurality of refractory ceramic tile members each having a first surface adapted to face against the inside surface of the high-temperature enclosure, and a second surface adapted to fasten onto the ceramic fiber insulation layer;

and wherein the second surfaces of each of said tile members includes an array of ceramic hook members that project from said second surface and latch onto fibers of said ceramic fiber insulation layer; wherein said array of hook members are unitarily formed with the respective tile members and are of a suitable size, having a length on the order of about 0.25 inches, and density, between one hook per 10 $cm^2$ and 50 hook members per $cm^2$, to engage said ceramic fiber insulation layer and support it on the inside surface of the high-temperature enclosure, such that the array of ceramic hook members serve as a hook portion of a hook-and-loop fastening system and the ceramic fibers of the ceramic fiber insulating layer serve as a loop portion thereof.

2. Liner attachment according to claim 1 wherein said hook members are formed as an array of ceramic posts that extend distally from the second surface of the tile members and which have distal ends thereof bent in an upward direction.

* * * * *

UNITED STATES PATENT AND TRADEMARK OFFICE

CERTIFICATE OF CORRECTION

PATENT NO. : 8,627,776 B2
APPLICATION NO. : 13/222037
DATED : January 14, 2014
INVENTOR(S) : Chad A. Sheckler It is certified that error appears in the above-identified patent and that said Letters Patent is hereby corrected as shown below:

On the Title Page

Item (12) UNITED STATES PATENT:

"Scheckler" should read --Sheckler--.

Item (75) Inventor:

"Scheckler" should read --Sheckler--.

Signed and Sealed this
First Day of April, 2014

Michelle K. Lee

Michelle K. Lee
*Deputy Director of the United States Patent and Trademark Office*